United States Patent [19]

Hayes

[11] 4,356,942

[45] Nov. 2, 1982

[54] INTERNAL FRAME RUCKSACK

[76] Inventor: James A. Hayes, "Sonora", Drakelands, County Kilkenny, Ireland

[21] Appl. No.: 190,184

[22] Filed: Sep. 24, 1980

[30] Foreign Application Priority Data

Sep. 24, 1979 [IE] Ireland ..... 1814/79

[51] Int. Cl.[3] ..... A45F 3/04

[52] U.S. Cl. ..... 224/211; 210/213; 210/263

[58] Field of Search ..... 224/211, 209, 210, 212, 224/213, 259, 261, 262, 263

[56] References Cited

U.S. PATENT DOCUMENTS

| | | | |
|---|---|---|---|
| 990,837 | 5/1911 | Carlson | 224/210 |
| 2,421,244 | 10/1943 | Daiber . | |
| 3,233,803 | 2/1966 | Gray | 224/263 X |
| 3,347,429 | 10/1967 | Ruth, Jr. | 224/213 X |
| 3,734,366 | 5/1973 | Wood | 224/25 A |
| 3,957,184 | 5/1976 | Shurman | 224/211 |

FOREIGN PATENT DOCUMENTS

| | | |
|---|---|---|
| 2036364 | 12/1970 | France . |
| 2371164 | 6/1978 | France . |
| 186978 | 2/1937 | Switzerland . |
| 339335 | 8/1959 | Switzerland . |
| 539388 | 9/1941 | United Kingdom . |

*Primary Examiner*—Steven M. Pollard

*Attorney, Agent, or Firm*—Stevens, Davis, Miller & Mosher

[57] ABSTRACT

The invention provides an internal frame rucksack in which the frame comprises at least two longitudinal frame members of substantially rigid material located in spaced-apart relationship within the rear wall of the sack, the frame members extending substantially from the bottom to the top of the sack wall, and each being provided adjacent their upper ends with at least one aperture, and wherein the apertures in the frame members correspond with spaced-apart apertures in a plate located externally of the wall of the sack and to which plate the frame members are secured by means of bolts or the like which pass through the wall of the sack, and wherein the plate includes a plurality of slots to selected ones of which the straps of a carrying harness may be attached. The location of the slots are so arranged on the plate that different width spacings and length spacings of the carrying straps can be selected.

6 Claims, 5 Drawing Figures

INTERNAL FRAME RUCKSACK

The invention relates to rucksacks and is particularly concerned with rucksacks having an internal frame.

External frame rucksacks are well known. They comprise a carrying frame to which is attached a carrying harness and usually also a waistband. The sack is attached to and hung from the frame by straps or the like. External frame rucksacks have the advantage that there is an even spread of weight over the shoulders and hips but they suffer from the disadvantage that because the frame is located externally of the sack the whole construction is quite bulky and usually has awkwardly projecting corners. Thus, external frame rucksacks are not generally suitable for such sports as mountaineering and skiing in which it has been more usual to use a frameless rucksack.

However, in recent years internal frame rucksacks have come on the market and have the advantage of being cheaper, less bulky and more adaptable than their external frame counterparts. In known internal frame rucksacks the frame usually comprises strips of flat bar or tube located in the rear wall (that is the wall abutting the back of the wearer) of the sack, and the harness is attached by stitching to the rear wall. Such conventional internal frame rucksacks suffer from a number of disadvantages. Firstly, the length or position of the straps or waistband is not readily adjustable. Secondly, the weight carrying capabilities of the rucksack are restricted to the amount that can safely be entrusted to the stitching holding the waistband and shoulder straps, and thirdly balance and stability are restricted due to excessive pull on the wearer's shoulders.

It is an object of the invention to overcome this disadvantage and to provide an internal frame rucksack which is of a relatively simple but strong construction and which provides for adjustment of the length and width of the carrying harness.

Accordingly, the invention provides an internal frame rucksack in which the frame comprises at least two longitudinal frame members of substantially rigid material located in spaced-apart relationship within the rear wall of the sack, the frame members extending substantially from the bottom to the top of the sack wall, wherein the frame members are provided adjacent their upper ends with means for releasably securing the frame members to a plate located externally of the rear wall of the sack, and wherein the plate includes a plurality of attachment means to selected ones of which straps of a carrying harness may be attached. Suitably, each frame member is provided adjacent its upper end with at least one aperture, the apertures in the frame members correspond with spaced-apart apertures in the plate, and wherein the apertures receive releasable securing means whereby the plate is secured to the frame members. Preferably, there are at least two apertures in each frame member adjacent the upper end thereof so that the plate may be secured to the frame members at selected positions. The releasable securing means may comprise a nut and bolt.

In a preferred embodiment the frame members are located in pockets formed in the rear wall of the sack, and at the bottom of the wall the frame members are spaced-apart a distance substantially equal to the width of the wall but are inclined towards each other towards the top where they are attached to the plate. Suitably the lower ends of the frame members are also each provided with an aperture or apertures to which a waistband portion of a carrying harness may be attached.

Preferably, the attachment means on the plate comprises a plurality of slots formed in the plate through which a buckle strap may be passed and attached. The location of the slots are so arranged on the plate that different width spacings and length spacings of the carrying straps can be selected. Furthermore, the plate can be inverted and bolted to the frame members in the inverted position, or can be bolted to the second pair of apertures in the frame member, thus providing for many combinations of width and length spacings for the carrying straps.

Suitably, the frame members and plate are made from metal and aluminium has been found to be particularly suitable because it is strong yet light in weight, and can be bent to the contour of the back.

One embodiment of the invention is hereinafter described with reference to the accompanying drawings, wherein.

Figure 1:
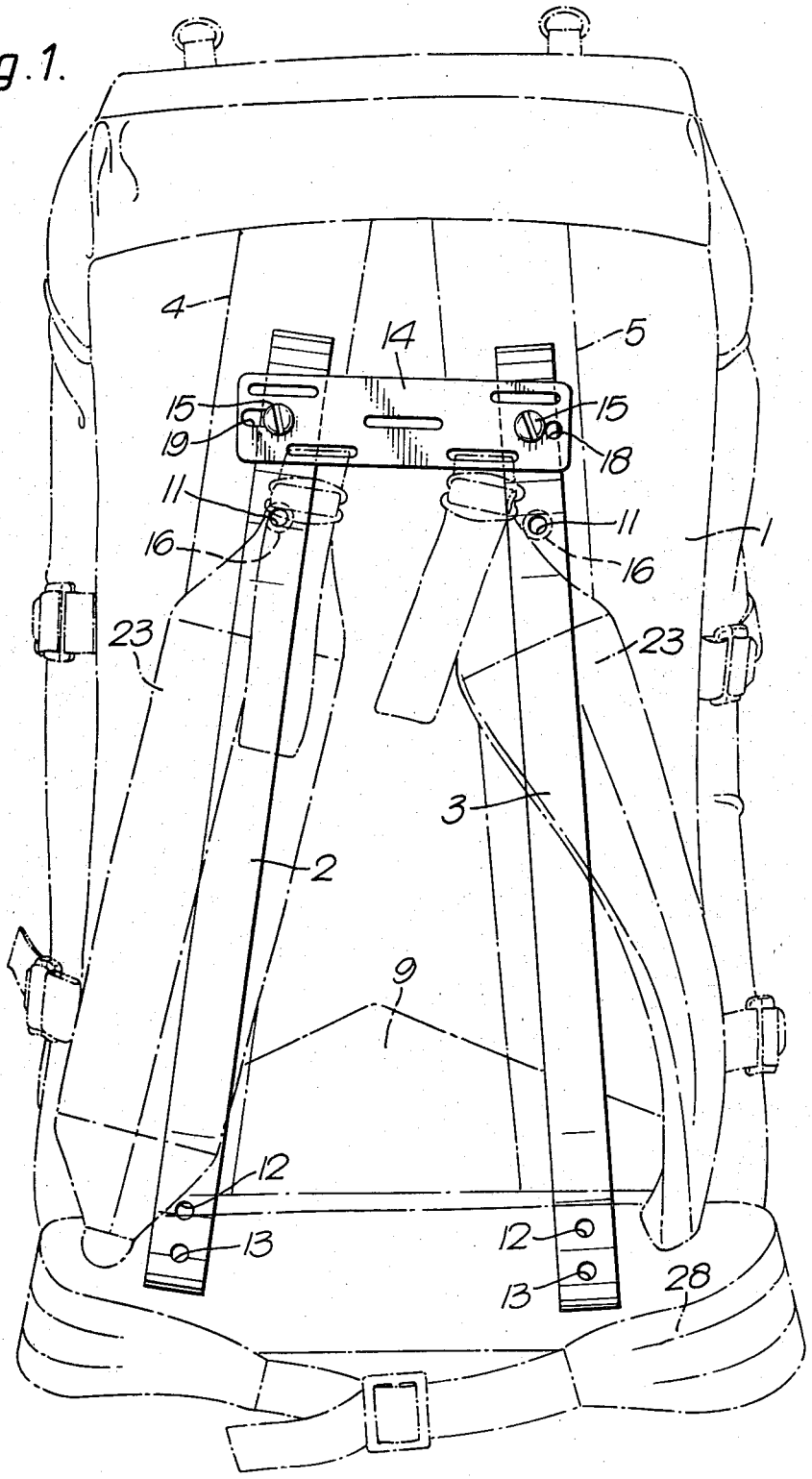
FIG. 1 is an elevation of an internal frame of a rucksack according to the invention with the rear wall of the sack shown in phantom lines.

Referring to the drawings, an internal frame rucksack comprises a sack 1 made from any suitable material but preferably is made from nylon cloth suitably waterproofed. The internal frame comprises two frame members 2, 3 which preferably are made from lengths of anodised aluminium flat bar. Suitably they each have a thickness of about ½ inch, a width of about 1 inch and a length of about 24 inches. The bars are each located in a pocket 4, 5 formed in the rear wall of the sack. As shown more clearly in FIG. 2, each pocket is formed of an inner length of nylon cloth 6 which is stitched along its longitudinal edges to the material forming the rear wall 7 of the sack. A strip of cellular foamed plastics 8 is located in the pocket between the frame member 2 and the rear wall 7 and serves to act as a cushion between the frame member and the back of the person carrying the rucksack. A further pad 9 of foamed plastics extends across the width of the rucksack at a position where it contacts the small of the back of the user.

The pockets commence adjacent each lateral edge of the bottom of the rear wall of the sack and are inclined inwardly towards the top of the rear wall. The pockets are open at the bottom so that the frame members 2, 3 can be slid in and out.

Figure 2:
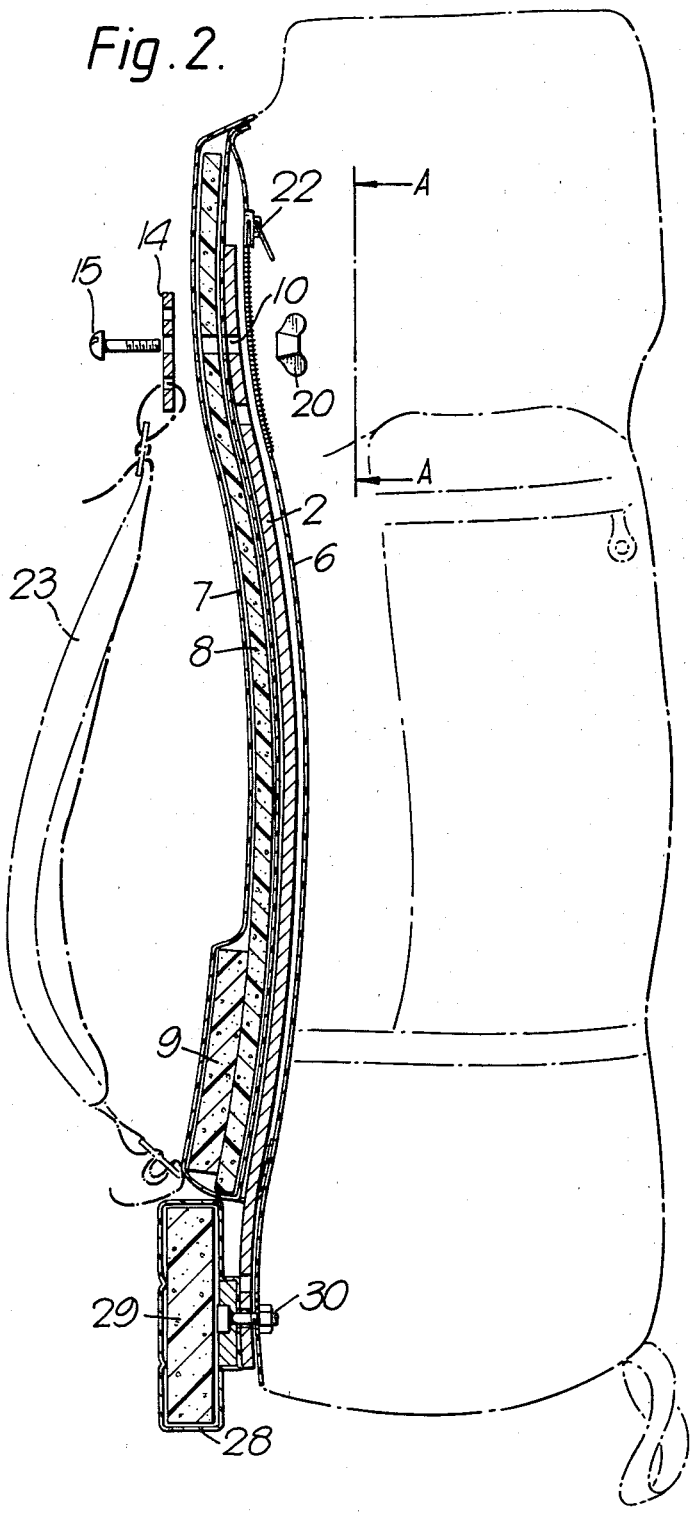
FIG. 2 is a side elevation, partly in section, of the sack of FIG. 1.

As shown in FIG. 2 the frame members are preferably contoured to the shape of the back of the user. Each frame member is provided adjacent its upper end with two circular holes 10, 11 drilled through the bar at longitudinally spaced locations. A similar pair of holes 12, 13 are located in each frame member adjacent the lower end thereof.

Figure 3:
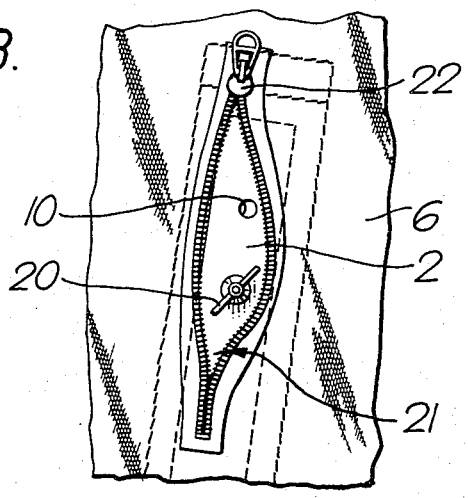
FIG. 3 shows a detail on the line A—A of FIG. 2.
Figure 4:
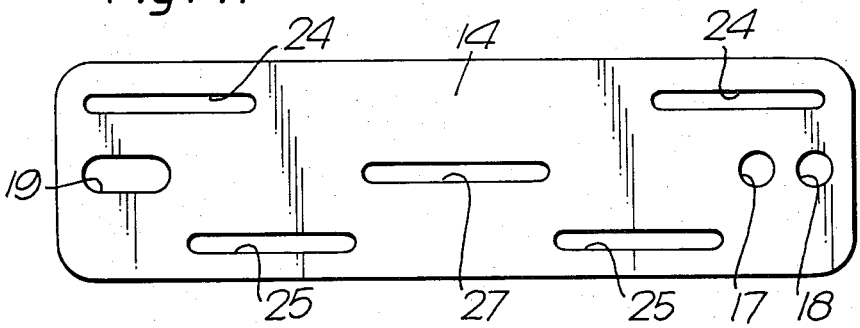
FIG. 4 is a front elevation of a plate for use in the invention.
Figure 5:
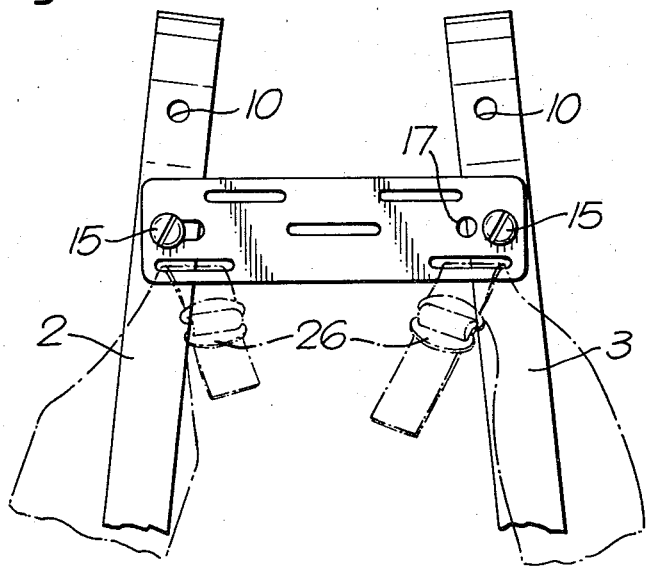
FIG. 5 shows the plate in a second position.

When the frame members are in position in the pockets 4, 5 a plate 14 positioned to the exterior of the rear wall 7 of the sack is bolted to the frame members by bolts 15 which pass through aperture 16 formed in the nylon material forming the wall 7. The edge of the material surrounding the aperture 16 is strengthened by means of eyelets. The plate is shown in more detail in FIG. 4. Suitably it is also made from anodised aluminium and may measure, for example, $5\frac{1}{4}$ inches in width, $1\frac{1}{2}$ inches in height and $\frac{1}{8}$ inch in thickness. The plate is drilled with bolt-receiving holes 17, 18 and a bolt-receiving slot 19. If the plate is attached to the upper holes 10, 10 of the frame members 2, 3 as shown in FIG. 1, a bolt 15 is located in the outer hole 18 of the plate and to the outer edge of the slot 19. The plate 14 can, however, also be bolted to the lower holes 11, 11 of the frame members, as shown in FIG. 5, in which case the bolts pass through the inner hole 17 of the plate and to the inner edge of the slot 19. The bolts are suitably tightened and held in place by means of wing nuts 20 located within the pockets 4, 5. As illustrated in FIG. 3 access to the wing nuts is obtained from within the bag by means of a slit opening 21 in the lining 6, which opening is normally closed by means of a water-proof nylon zip fastener 22.

The plate 14 is formed with attachment points for carrying straps 23 of the rucksack. These attachment points are in the form of a pair of slots 24, and a pair of slots 25, either of which pair may be selected depending upon the desired position of the straps. The ends of the straps are adapted to pass through the slots to which they are secured by buckles 26. A fifth slot 27 is formed in the plate 14 and this may be used for attachment of a hauling loop.

The holes 12, 13 in the lower end of each frame member are used for attachment of a hip band 28 which contains foamed plastics padding 29. The hip band 28 is completely separate from the remainder of the rucksack and it is attached directly to the frame members by bolts or pins 30 which pass through either the pair of holes 12, 12 or 13, 13.

It will be appreciated that the construction of the invention offers a number of important advantages over known internal frame rucksacks. Because of the fact that the shoulder straps 23 can be attached to either the slots 24, or the slots 25 of the plate, that the plate can be inverted or moved to two positions on the frame members, a variety of different back lengths can be provided for. Furthermore, it will be noted that the distance between the two slots 24 is greater than the distance between the two slots 25 which provide for adjustable spacing between the shoulder straps. Another important feature of the present invention is that the shoulder straps are attached directly to the internal frame thus distributing the weight all along the spinal column down to the hip belt. This has the added advantage that the shoulder straps do not pull directly from the sack fabric but from the internal frame which provides a much stronger construction.

Because the internal frame is located in closed pockets within the wall of the sack there is no danger of water entering the interior of the bag through the bolt holes. Finally, further possibilities of adjustment of the harness are obtained due to the fact that the hip band is independent of the sack and can be attached to the lower end of the internal frame at either of two locations.

I claim:

1. An internal frame rucksack comprising a sack made from a flexible material, a frame comprising at least two longitudinal frame members of substantially rigid material located in spaced-apart relationship in pockets within the rear wall of the sack, a carrying harness having at least two shoulder straps, a plate located externally of the rear wall of the sack at a location adjacent the top of the sack, releasable securing means rigidly connecting the plate to the frame members adjacent the upper ends thereof, a plurality of slots formed in the plate to selected ones of which the upper ends of the shoulder straps may be attached whereby there is a direct connection between the upper ends of the shoulder straps and the frame members, and wherein there is at least two pairs of slots in the plate and the slots are so spaced apart that different width spacings and length spacings of the shoulder straps may be selected.

2. An internal frame rucksack comprising a sack made from a flexible material, a frame comprising at least two longitudinal frame members of substantially rigid material located in spaced-apart relationship in pockets within the rear wall of the sack, a carrying harness having at least two shoulder straps, a plate located externally of the rear wall of the sack at a location adjacent the top of the sack, releasable securing means rigidly connecting the plate to the frame members adjacent the upper ends thereof, the connection being made through apertures in the plates which are adapted to coincide with one of at least two pairs of apertures in the upper ends of the frame members whereby the plate may be secured to the frame members at selected positions on the frame members, a plurality of slots formed in the plate to selected ones of which the upper ends of the shoulder straps may be attached whereby there is a direct connection between the upper ends of the shoulder straps and the frame members, and wherein there are at least two pairs of slots in the plate and the slots are so spaced apart that different width spacings and length spacings of the shoulder straps may be selected.

3. A rucksack as claimed in claims 1 or 2, wherein the plate may be secured to the frame members in an inverted position of the plate to provide further combinations of width and length spacings of the carrying straps.

4. A rucksack as claimed in claims 1 or 2, wherein the releasable securing means comprises a nut and bolt.

5. A rucksack as claimed in claims 1 or 2, wherein the lower ends of the frame members are spaced-apart a distance substantially equal to the width of the rear wall of the sack but are inclined towards each other in the vicinity of their top ends where they are attached to the plate.

6. A rucksack as claimed in claims 1 or 2, wherein each frame member is provided at the lower end thereof with at least one aperture to which a waistband portion of a carrying harness may be attached.

* * * * *